US009427789B2

(12) United States Patent
Kong

(10) Patent No.: US 9,427,789 B2
(45) Date of Patent: Aug. 30, 2016

(54) DEVICE AND METHOD FOR HOT STAMPING

(71) Applicants: HYUNDAI MOTOR COMPANY, Seoul (KR); KIA MOTORS CORPORATION, Seoul (KR)

(72) Inventor: Ho Young Kong, Ulsan (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 14/550,534

(22) Filed: Nov. 21, 2014

(65) Prior Publication Data

US 2015/0367396 A1 Dec. 24, 2015

(30) Foreign Application Priority Data

Jun. 18, 2014 (KR) ..... 10-2014-0074420

(51) Int. Cl.

| | |
|---|---|
| ***B21D 22/02*** | (2006.01) |
| ***B21D 19/08*** | (2006.01) |
| ***B21D 37/16*** | (2006.01) |
| ***C22C 38/54*** | (2006.01) |
| ***C22C 38/44*** | (2006.01) |
| ***C21D 1/673*** | (2006.01) |
| *C21D 8/00* | (2006.01) |
| *C21D 1/18* | (2006.01) |

(52) U.S. Cl.

CPC ..... *B21D 22/022* (2013.01); *B21D 19/08* (2013.01); *B21D 37/16* (2013.01); *C21D 1/673* (2013.01); *C22C 38/44* (2013.01); *C22C 38/54* (2013.01); *C21D 1/18* (2013.01); *C21D 8/005* (2013.01)

(58) Field of Classification Search

CPC .... B21D 19/08; B21D 19/084; B21D 22/02; B21D 22/022; B21D 22/208; B21D 24/04; B21D 24/16; B21D 37/16; B21K 29/00; B21J 1/06

USPC ..... 72/452.1, 452.8, 452.9

See application file for complete search history.

(56) References Cited

U.S. PATENT DOCUMENTS

| | | | | |
|---|---|---|---|---|
| 7,047,779 | B2 * | 5/2006 | Kruger | B21D 22/02 72/57 |
| 7,204,119 | B2 * | 4/2007 | Kruger | B21D 22/02 73/342.7 |
| 8,230,713 | B2 * | 7/2012 | Krajewski | B21D 37/16 29/421.1 |

FOREIGN PATENT DOCUMENTS

| | | | |
|---|---|---|---|
| KR | 20-1998-0027994 | U | 8/1998 |
| KR | 10-2013-0015633 | A | 2/2013 |
| KR | 10-2013-0043310 | A | 4/2013 |
| KR | 10-2013-0114065 | A | 10/2013 |

* cited by examiner

*Primary Examiner* — Teresa M Ekiert

(74) *Attorney, Agent, or Firm* — McDermott Will & Emery LLP

(57) ABSTRACT

A device for hot stamping includes a lower mold having a shape corresponding to a bottom of a product material. An upper mold has a shape corresponding to a top of the product material and presses the product material with the lower mold. A blank holder is disposed inside the upper mold and fixes a blank between the upper mold and the lower mold. A cam has a shape corresponding to a flange of the product material and forms the flange of the product material by moving up or down along an inner side of the blank holder.

8 Claims, 6 Drawing Sheets

DEVICE AND METHOD FOR HOT STAMPING

CROSS-REFERENCE TO RELATED APPLICATION

This application claims the benefit of priority to Korean Patent Application No. 10-2014-0074420 filed in the Korean Intellectual Property Office on Jun. 18, 2014, the entire contents of which are incorporated herein by reference.

TECHNICAL FIELD

The present disclosure relates to a device and a method for hot stamping.

BACKGROUND

The use of ultra-high strength steel has been increased in the automotive industry to reduce weight of a vehicle body and to improve safety in a collision. Hot stamping (also called "hot press forming") has been used as one of ways of forming ultra-high strength steel of 1500 MPa.

The hot stamping is an engineering method of producing an ultra-high strength vehicle body part through a phase transformation to martensite by heating a blank up to an austenite region, press-forming the blank, and then rapidly cooling the blank in a mold.

The hot stamping is often used to ensure strength of crash members such as a center pillar, a roof rail, a bumper, and an impact beam on the vehicle body and to reduce weight by removing reinforcing members.

According to the related art, a flange of a product material formed by hot stamping and a mold are brought in contact with each other first, and thus, heat is removed at the flange first.

Accordingly, the phase transformation to martensite occurs at the flange first, so elongation decreases at the flange, and the material is not smoothly supplied, and thus breaking-off occurs.

Further, when the flange is welded thereafter, the welded portion decreases in strength and thus easily breaks.

The above information disclosed in this Background section is only for enhancement of understanding of the background of the invention, and therefore, it may include information that does not form the prior art that is already known in this country to a person of ordinary skill in the art.

SUMMARY OF THE INVENTION

Exemplary embodiments of the present inventive concept provide a device for hot stamping and a method thereof.

According to an exemplary embodiment of the present inventive concept, a device for hot stamping includes a lower mold having a shape corresponding to the bottom of a product material. An upper mold has a shape corresponding to a top of the product material and presses the product material with the lower mold. A blank holder is disposed inside the upper mold and fixes a blank between the upper mold and the lower mold. A cam has a shape corresponding to a flange of the product material and forms the flange by moving up or down along an inner side of the blank holder.

The device may further include a first cam actuator that is coupled to the upper mold and has a first inclined portion at one side. A second cam actuator has a second inclined portion selectively coming in contact with the first inclined portion at one end and has a third inclined portion at another end. A fourth inclined portion is formed at one end of the cam and contact with the third inclined portion. As the upper mold moves down, the first inclined portion of the first cam actuator and the second inclined portion of the second cam actuator contact with each other to move the second cam actuator. The third inclined portion of the second cam actuator pushes the fourth inclined portion to move the cam upward.

The device may further include an elastic member disposed between the upper mold and the blank holder and being compressed by the upward movement of the cam.

The device may further include a guide rail disposed on and under the second cam actuator and providing a path for left/right sliding of a second cam.

The device may further include a guide rail disposed on a side of the cam and providing a path for upward or downward movement of the cam.

The lower mold, the upper mold, the blank holder, and the cam may include a cooling system.

The cooling system may further include a cooling channel for circulating a cooling medium.

The cooling system may further include a cooling tower for cooling the cooling medium and a pump for delivering the cooling medium by a pump pressure.

According to another exemplary embodiment of the present inventive concept, a method of hot stamping includes fixing a blank between a lower mold and an upper mold of a device for hot stamping. The blank is pressed and formed with the lower mold and the upper mold. A portion being in contact with the lower mold and the upper mold is rapidly cooled, and a flange of a product material is slowly cooled. The flange is formed by a cam.

The step of forming the flange by the cam may phase transform by rapidly cooling the blank after the portion being in contact with the lower mold and the upper mold starts transforming.

The phase transformation may be performed by rapidly cooling under a martensite transformation end temperature from an austenite region without bainite and ferrite transformation reactions.

The rapid cooling speed may be 50° C./s to 150° C./s, and a slow cooling speed may be 5° C./s to 20° C./s.

The blank may include Ni of 0.01 wt % to 0.03 wt %, Cr of 0.1 wt % to 0.5 wt %, Mo of 0.001 wt % to 0.012 wt % and may further include B of 0.001 wt % to 0.005 wt %, and a balance may include Fe and impurities inevitably included in steel.

According to exemplary embodiments of the present invention, forming of a flange of a product material can be performed in an austenite region with high elongation, so it is possible to prevent breaking-off and improve formability.

DETAILED DESCRIPTION OF THE EMBODIMENTS

Figure 1:
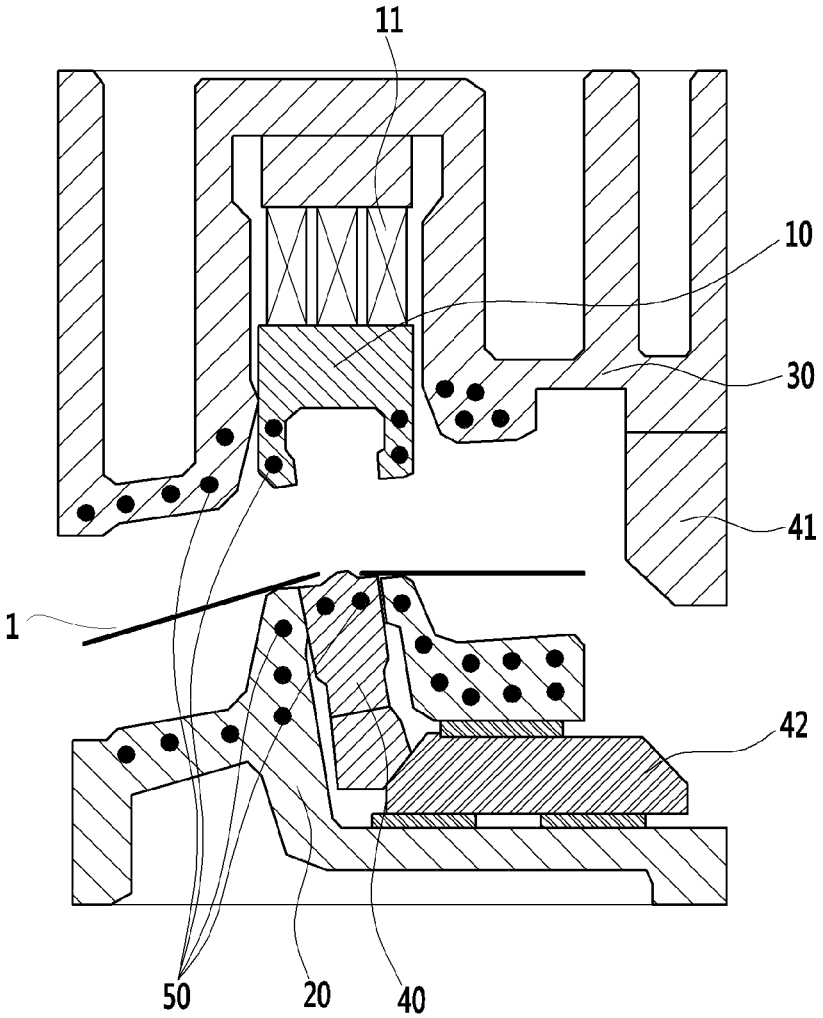
FIG. 1 is a view illustrating a structure of a device for hot stamping according to an exemplary embodiment of the present inventive concept.

Hereinafter, exemplary embodiments of the present inventive concept will be described in detail. The exemplary embodiments, however, are provided as examples, and the present disclosure is not limited thereto, but defined within the range of claims to be described below.

The thicknesses of lines and the sizes of the components illustrated in the drawings may be exaggerated for the clarity and convenience of description.

Further, the terminologies described below are terminologies determined in consideration of the functions in the present disclosure and may be construed in different ways by the intention of users and operators or the custom.

Therefore, the definitions of the terminologies should be construed on the basis of the contents throughout this specification.

FIG. 1 is a view illustrating a structure of a device for hot stamping according to an exemplary embodiment of the present inventive concept.

Referring to FIG. 1, a device for hot stamping according to an exemplary embodiment of the present inventive concept can be used for hot press forming equipment that obtains a high-strength formed-product by press-forming and rapidly cooling a blank 1 heated at a high temperature.

The device for hot stamping according to an exemplary embodiment of the present inventive concept includes a lower mold 20 having a shape corresponding to a bottom of a product material. An upper mold 30 has a shape corresponding to a top of the product material and presses the product material with the lower mold 20. A blank holder 10 is disposed inside the upper mold 30 and fixes the blank 1 between the upper mold 30 and the lower mold 20. A cam 40 has a shape corresponding to a flange of the product material and forms the flange of the product material by moving up or down along an inner side of the blank holder 10.

The device may further include a first cam actuator 41 that is disposed at a lower right side of the upper mold 30 and has an inclined surface at an end. The inclined surface of the first cam actuator 41 contacts with and moves along an inclined surface of a second cam actuator 42 from a right to left or left to right direction when the upper mold 30 moves up or down. The second cam actuator 42 having the inclined surface at one side contacts with and slides along the inclined surface of the first cam actuator 41 from the right to left or left to right direction while the first cam actuator 41 moves up or down. The second cam actuator 42 has an inclined surface at another side and moves up/down the cam 40 by sliding to the left/right in contact with a lower end of the cam 40.

A guide rail (not illustrated) providing a path for the left/right sliding motion of a second cam actuator may be disposed on and under the second cam actuator 42. Further, a guide rail (not illustrated) providing a path for the up/down motion of the cam 40 may be disposed at a side of the cam 40.

The lower mold 20, the upper mold 30, the blank holder 10, and the cam 40 may include a cooling system 50 therein. The cooling system may include a coolant or a refrigerant as a cooling medium and include further cooling channels for circulating the cooling medium.

The cooling system may further include a cooling tower for cooling the cooling medium and a pump for delivering the cooling medium using pressure (which are not illustrated).

Figure 2:
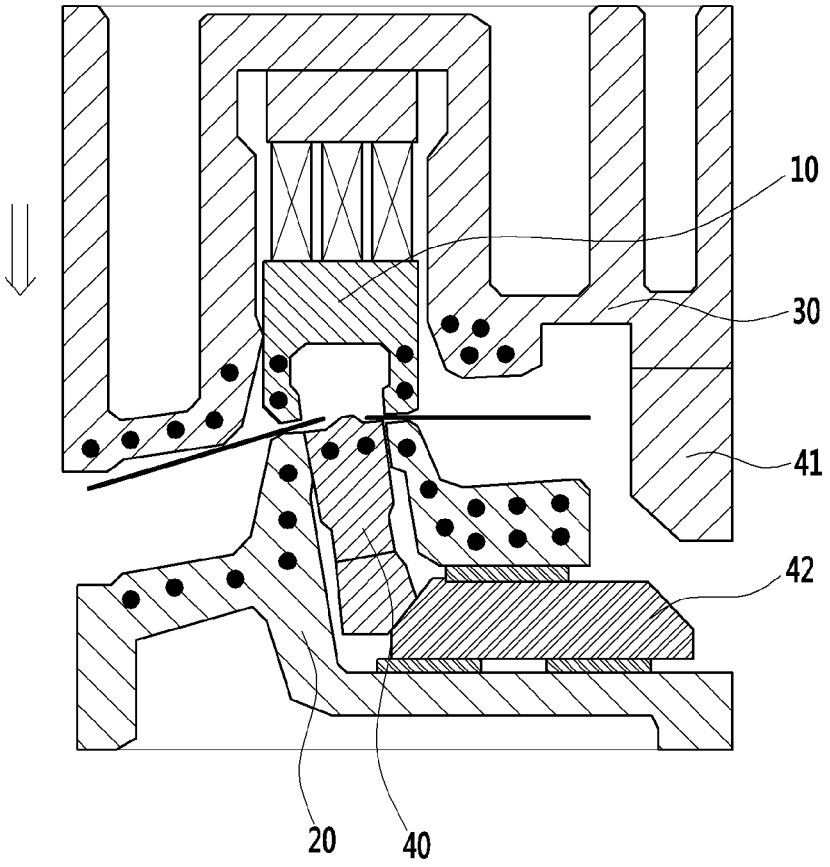
FIG. 2 is a view illustrating a blank fixed by a blank holder of the device for hot stamping according to an exemplary embodiment of the present inventive concept.
Figure 3:
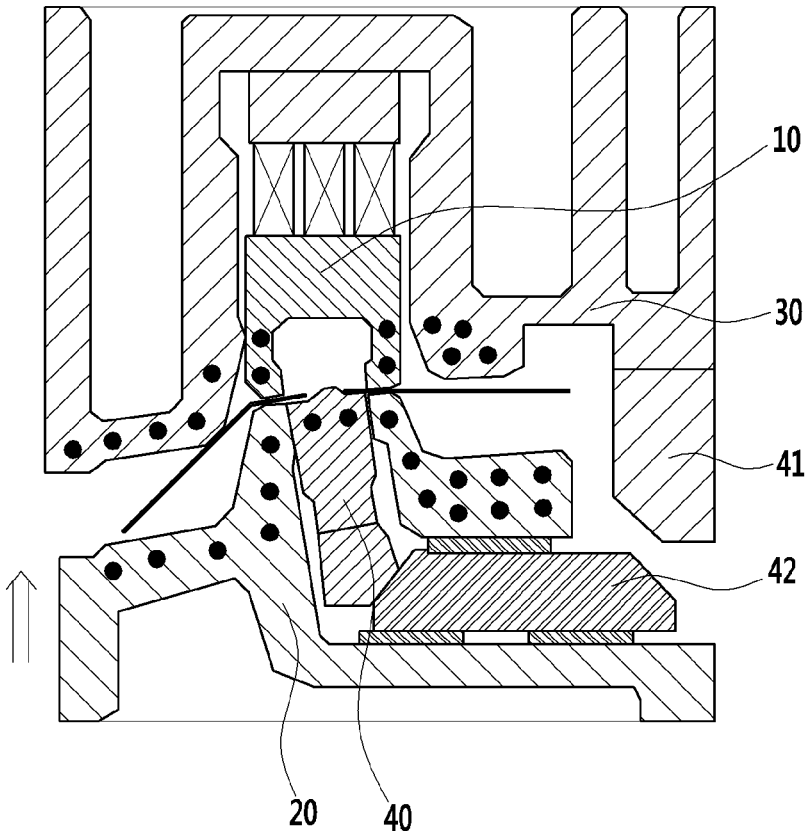
FIG. 3 is a view illustrating an upper mold moving down in the device for hot stamping according to an exemplary embodiment of the present inventive concept.
Figure 4:
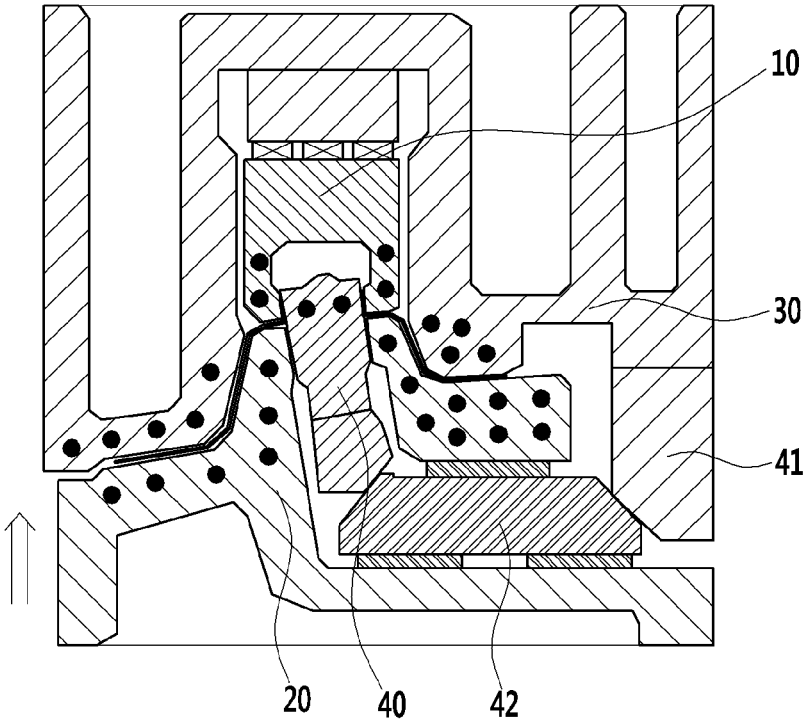
FIG. 4 is a view illustrating a cam in an upper position, in the device for hot stamping according to an exemplary embodiment of the present inventive concept.

FIG. 2 is a view illustrating a blank fixed by a blank holder of the device for hot stamping according to an exemplary embodiment of the present inventive concept. FIG. 3 is a view illustrating an upper mold moving down in the device for hot stamping according to an exemplary embodiment of the present inventive concept. FIG. 4 is a view illustrating a cam in an upper position, in the device for hot stamping according to an exemplary embodiment of the present inventive concept.

The blank 1 is composed of a hardened material and is heated above a forming temperature. The forming temperature may be an austenite region temperature over a martensite transformation start temperature $M_s$, even in continuous cooling of the blank.

When the blank 1 is loaded, the blank holder 10 moves down and fixes the blank 1. After the blank is fixed, the upper mold 30 moves down and forms the blank 1.

When the upper mold completely moves down, portions of the blank 1 which is in contact with the blank holder 10, the lower mold 20, and the upper mold 30 transforms into martensite by being rapidly cooled under temperature $M_f$ (martensite transformation end temperature).

The rapid cooling speed may be 50° C./s to 150° C./s, 70° C./s to 130° C./s, or 90° C./s to 110° C./s.

Figure 5:
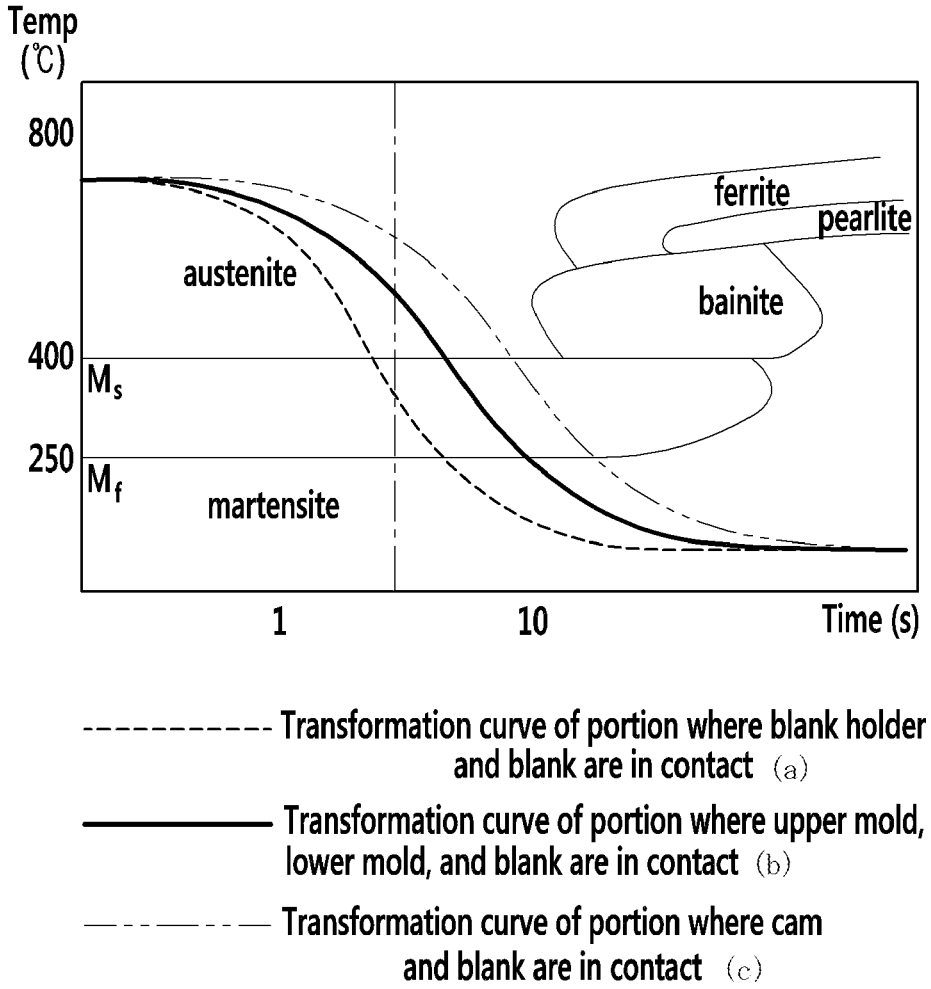
FIG. 5 is a graph illustrating transformation curves at which a blank holder, upper and lower molds, a cam, and a blank contact with each other of the device for hot stamping according to an exemplary embodiment of the present inventive concept.

The blank holder 10 and the blank 1 contact with each other before the upper mold 30 contacts with the blank 1, thus during the phase transformation to martensite, the portion of the blank 1 being in contact with the blank holder 10 transforms, and then the portion of the blank 1 being in contact with the lower mold 20 and the upper mold 30 starts transforming, as illustrated in lines (a) and (b) of FIG. 5.

In the blank 1, a flange which does not contact the blank holder 10, the lower mold 20, and the upper mold 30 is slowly cooled by air.

When pressing and forming by the upper mold 30 and the lower mold 20 of the blank 1 is completed, the cam 40 moves upward and forms the flange. The forming of the flange by the cam 40 may be completed in an austenite region.

The flange of the blank 1 to come in contact with the cam 40 is slowly cooled by air and maintained in the austenite region before it comes in contact with the cam 40, as illustrated in line (c) of FIG. 5, and then it transforms to martensite by rapidly cooling under the temperature $M_f$ (martensite transformation end temperature).

Further, the phase transformation may not have bainite and ferrite transformation reactions.

The slow cooling speed may be 5° C./s to 20° C./s. The rapid cooling speed may be 50° C./s to 150° C./s, 70° C./s to 130° C./s, or 90° C./s to 110° C./s.

Referring to FIGS. 1 to 4, the cam 40 can move up by the first cam actuator 41 and the second cam actuator 42.

The first cam actuator 41 is combined with the upper mold 30 and has a first inclined portion at one end. A second inclined portion that selectively comes in contact with the first inclined portion is formed at one end of the second cam actuator 42, and a third inclined portion is formed at the opposite end. A fourth inclined portion is formed at one end of the cam 40 and comes in contact with the third inclined portion.

As the first cam actuator 41 moves down along the upper mold 30, the first inclined portion of the first cam actuator 41 and the second inclined portion of the second cam actuator 42 contact with each other, thereby moving the second cam actuator 42. The third inclined portion of the second actuator 42 pushes the fourth inclined portion of the cam 40, and accordingly, the cam 40 moves up.

Further, an elastic member 11 is disposed between an upper end inside the upper mold 30 and the blank holder 10, thus compressing the blank 1 to form the flange with the upward movement of the cam 40.

A method of hot stamping according to an exemplary embodiment of the present inventive concept includes pressing and forming a blank with a lower mold and an upper mold. A formed portion of the blank pressed by the lower mold and the upper mold is rapidly cooled, and a flange of the blank is slowly cooled. The flange is formed by a cam after the formed portion being in contact with the lower mold and the upper mold starts transforming.

The blank may include Ni of 0.01 wt % to 0.03 wt %, Cr of 0.1 wt % to 0.5 wt %, Mo of 0.001 wt % to 0.012 wt % and may further include B of 0.001 wt % to 0.005 wt %, and a balance may include Fe and impurities inevitably included in steel.

Figure 6:
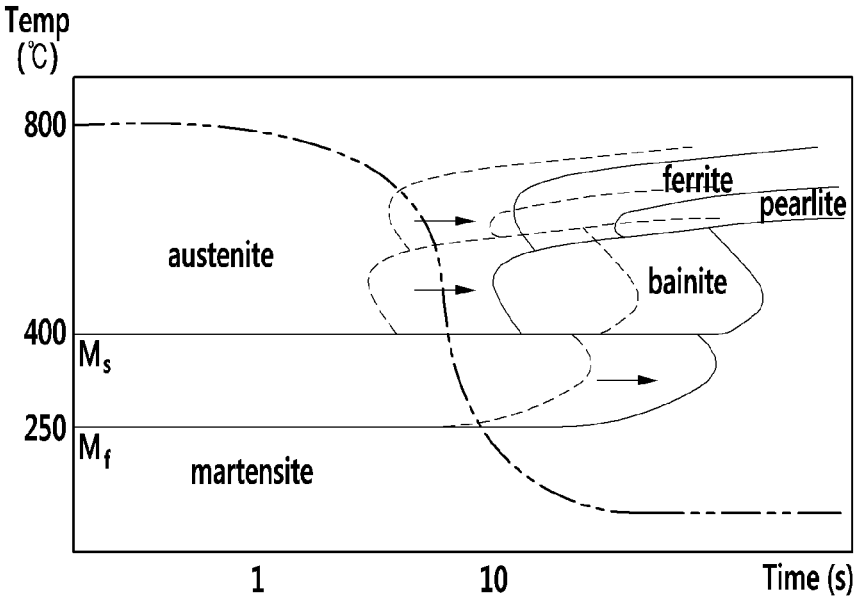
FIG. 6 is a graph illustrating an effect by transformation delay of ferrite, pearlite, and bainite in a blank according to an exemplary embodiment of the present inventive concept.

By adding Ni, Cr, Mo to the blank, as illustrated in FIG. 6, the ferrite, pearlite, and bainite transformation curves move to the right along the time axis, and thus, the transformation is delayed. Accordingly, since the blank maintains to be in the austenite region during the delay, forming of the blank can start in the austenite region.

Although exemplary embodiments of the present inventive concept were described with reference to the accompanying drawings, the present inventive concept is not limited to the exemplary embodiments and modified in various ways. Further, it would be understood that the present disclosure may be implemented in other detailed ways by those skilled in the art without the scope and necessary components of the present disclosure changed. Therefore, the exemplary embodiments described above are only examples and should not be construed as being limitative in all respects.

What is claimed is:

1. A device for hot stamping, comprising:

a lower mold having a shape corresponding to a bottom of a product material;

an upper mold having a shape corresponding to a top of the product material and pressing the product material with the lower mold;

a blank holder disposed inside the upper mold and fixing a blank between the upper mold and the lower mold;

a cam having a shape corresponding to a flange of the product material and forming the flange of the product material by moving up or down along an inner side of the blank holder;

a first cam actuator coupled to the upper mold and having a first inclined portion at one end; and a second cam actuator having a second inclined portion selectively coming in contact with the first inclined portion at one end and having a third inclined portion at another end, wherein a fourth inclined portion is formed at one end of the cam and comes in contact with the third inclined portion, as the upper mold moves down, the first inclined portion of the first cam actuator and the second inclined portion of the second cam actuator contact with each other, and the second cam actuator moves, and the third inclined portion of the second cam actuator pushes the fourth inclined portion, and the cam moves upward.

2. The device of claim 1, further comprising:

an elastic member disposed between an upper end inner side of the upper mold and the blank holder, wherein the upward movement of the cam compresses the elastic member.

3. The device of claim 1, further comprising:

a guide rail disposed on and under the second cam actuator and providing a path for left/right sliding of the second cam actuator.

4. The device of claim 3, further comprising:

a guide rail disposed on a side of the cam and providing a path for the upward or downward movement of the cam.

5. The device of claim 1, wherein:

the lower mold, the upper mold, the blank holder, and the cam have a cooling system.

6. The device of claim 5, wherein:

the cooling system includes a cooling channel for circulating a cooling medium.

7. The device of claim 6, wherein:

the cooling system further includes a cooling tower for cooling the cooling medium and a pump for sending the cooling medium using a pump pressure.

8. The device of claim 1, wherein:

the blank is a hardened material by being heated above a forming temperature.

* * * * *